US006569245B2

(12) United States Patent
Krysa et al.

(10) Patent No.: US 6,569,245 B2
(45) Date of Patent: May 27, 2003

(54) METHOD AND APPARATUS FOR APPLYING A POWDER COATING

(75) Inventors: Valery Korneevich Krysa, Moscow region (RU); Aley Galeevich Mukhamedzyanov, Moscow region (RU); Vladislav Kuzmich Semenchenko, Moscow (RU)

(73) Assignee: Rus Sonic Technology, Inc., Arcadia, CA (US)

( * ) Notice: Subject to any disclaimer, the term of this patent is extended or adjusted under 35 U.S.C. 154(b) by 0 days.

(21) Appl. No.: 10/008,678

(22) Filed: Dec. 4, 2001

(65) Prior Publication Data

US 2003/0077384 A1 Apr. 24, 2003

(30) Foreign Application Priority Data

Oct. 23, 2001 (RU) ..... 01128459

(51) Int. Cl.[7] ..... B05C 19/00; B05B 7/16; B05B 7/06

(52) U.S. Cl. ..... 118/308; 118/302; 239/427.5; 239/79; 239/418; 239/428

(58) Field of Search ..... 118/308, 302; 239/79, 80, 82, 128, 135, 398, 418, 432, 428, 419.3, 422, 427.5; 451/102

(56) References Cited

U.S. PATENT DOCUMENTS

| | | | | | |
|---|---|---|---|---|---|
| 3,958,758 | A | * | 5/1976 | Piorkowski | 239/427.5 |
| 4,815,414 | A | * | 3/1989 | Duffy et al. | 118/308 |
| 5,302,414 | A | * | 4/1994 | Alkhimov et al. | 427/192 |
| 5,876,267 | A | * | 3/1999 | Kanda | 451/38 |
| 6,017,591 | A | * | 1/2000 | Popoola et al. | 427/449 |
| 6,283,386 | B1 | * | 9/2001 | Van Steenkiste et al. | 239/79 |

* cited by examiner

*Primary Examiner*—Richard Crispino
*Assistant Examiner*—Yewebdar T. Tadesse
(74) *Attorney, Agent, or Firm*—Lee & Hong

(57) ABSTRACT

The invention relates to the technology of applying a coating of powder materials by spraying and can be used for producing a coating of metals; their mechanical mixtures and dielectrics, adding various functional properties to treated surfaces. The proposed method of applying a powder coating comprised as follows: producing a gas-carrier flow, mixing powder with it, accelerating the gas-powder flow in the nozzle, generating its preset profile, further simultaneously generating the second gas-carrier flow, heating it, generating its preset profile and accelerating it in the nozzle, after that superimposing the accelerated gas-powder flow of the preset profile over the gas-carrier flow of the preset profile, and directing the cumulative jet to an article.

9 Claims, 2 Drawing Sheets

METHOD AND APPARATUS FOR APPLYING A POWDER COATING

BACKGROUND OF THE INVENTION

1. Field of the Invention

The invention relates to the technology of applying a coating of powder materials by spraying. More specifically, the present invention relates to applying a coating of metals, their mechanical blends and dielectrics.

2. Discussion of the Related Art

Applying a powder coating using a gas-carrier flow to entrain powder particles and spraying the powder to a surface is known in the art. The powder is mixed with gas-carrier flow and the formed gas-powder flow is accelerated in a nozzle and directed to an article. Two prior art patents discussed below describe the current state of the art.

In U.S. Pat. No. 4,815,414, a method is disclosed which utilizes an apparatus consisting of a compressed air supply connected to a powder feeder equipped with a powder bunker and a dosing device and a mixing chamber. The inlet of the mixing chamber is connected to the dosing feeder, and its outlet is connected to the group of accelerating nozzles via a distributing collector.

The method of the '414 Patent is limited in that it is capable of only producing powder coatings having small thickness, since the gas-powder jet directed to an article has the temperature nearly equal to the temperature of the environment. In this case the efficiency of this method is limited to the group of thermoplastic polymers, which are applied to an article at cold state. In order to achieve a better cohesion of powders with the surface, it is required to heat the article to the temperature of the melting point of the applied material. It makes this process considerably difficult to implement and limits its application. In addition, the utilization of a distributing collector in the apparatus inevitably causes unequal distribution of the gas-powder mixture between the nozzles. Furthermore redistribution of the main gas-carrier flow between the nozzles severely reduces the energy of the flow in each nozzle, which involves reduction of the discharge of the carried gas-powder mixture, and accordingly reduces the efficiency of the process.

In WTO Patent 91/19016, a method of applying powder coatings is disclosed comprising a heated gas-carrier flow, a powder selected from a group of metals, their blends and dielectrics, with the particle size 1–50 $\mu$m, mixing with a gas-carrier flow, where the generated gas-powder flow is accelerated inside a nozzle and then a supersonic jet of the preset profile is formed and directed to a surface. In this case the supersonic jet of the preset profile is generated by the way of linear gas expansion. The apparatus for implementing the above method contains a compressed air supply connected by a gas pipe with a heating unit; a mixing chamber is connected to the powder feeder equipped with a powder bunker and a dosing device. The inlet of the mixing chamber is connected to the intermediate nozzle, and its outlet to the accelerating nozzle.

The disadvantage of this method is that it is efficient only for the particles of the small size, in particular 1–50 $\mu$m. Generation of the preset profile of the gas-powder jet by the way of the linear expansion of the gas is reasonable only for the small size particles, since the unbalance of the profiles of the gas jet and powder parameters dramatically increases as the particles size increasing. Moreover, a problem with the prior art device is that small powder particles are quickly oxidized in active gas surrounding. Thus, when the gas jet temperature increases, the produced coatings have high-porous, heterogeneous and thermally stressed structure, which reduces the quality of the applied coating. Therefore, the generation of the preset profile of the gas-powder jet becomes no more efficient than the prior art. Further, generation of the profile of gas-powder jet by the way of linear expansion requires the accelerating nozzle of considerable length, within the limits of which particles of gas-powder jet are accelerated until their threshold value, at which particles deposit and cohere to an article. The increase of the size of the accelerating nozzle thereby causes the increase of the size of the apparatus itself, and therefore limits its application (e.g. in case of applying coatings to inner surface of articles).

Thus, there is a need in the art to provide improved method and apparatus of applying a coating of powder material with a wider range of particle sizes, improving the quality of the applied coating, and reducing the size of the spraying apparatus to allow for increased applicability.

SUMMARY OF THE INVENTION

The invention describes a method for applying to an article a coating of powder material from powder particles. The method comprises the steps of generating a first gas-carrier flow, entraining and mixing powder particles into the first gas-carrier flow, accelerating the generated gas-powder flow in the nozzle, generating a preset profile for the mixed gas-powder flow; generating a second gas-carrier flow, heating the second gas-carrier flow, generating a preset profile for the second gas-carrier flow, accelerating it in the nozzle, superimposing of the gas-powder flow over the second gas-carrier flow, and directing the superimposed flows to the article.

Independent generation and acceleration of the gas-powder and gas-carrier flows enables to shape profiles of gas and gas-powder flows due to their uniformity. And their following superimposition one over the other provides acceleration of the cumulative gas-powder jet, directed to an article, with a wide range velocity.

The above method is utilized by an apparatus consisting of a supply of compressed air connected to a heating unit; a mixing chamber is connected to a powder dosing feeder, equipped with a powder bunker and dosing equipment; the inlet of the mixing chamber is connected to the intermediate nozzle; an ejection cap and a nozzle unit, which has two accelerating nozzles. The accelerating nozzles are connected together so their outlet sections are in same plane, and the ejection cap is placed in the outlet of the nozzle unit. Each accelerating nozzle is equipped with a sprayer, capable of rotating in the sub-critical part of the nozzle. Furthermore the sprayer of the first accelerating nozzle is connected by the gas pipe to the outlet of the mixing chamber, and the sprayer of the second accelerating nozzle is connected to the compressed air supply via the heating unit.

In further embodiments, each accelerating nozzle is equipped with a profile-shaping plate fixed to the inner surface of the nozzle. It provides generation of the necessary profile of the gas-powder and gas-carrier flows at a small distance, essentially reducing the length of each accelerating nozzle.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention. The above and other objects and features of the present invention will become apparent from the following description of the preferred configuration given in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
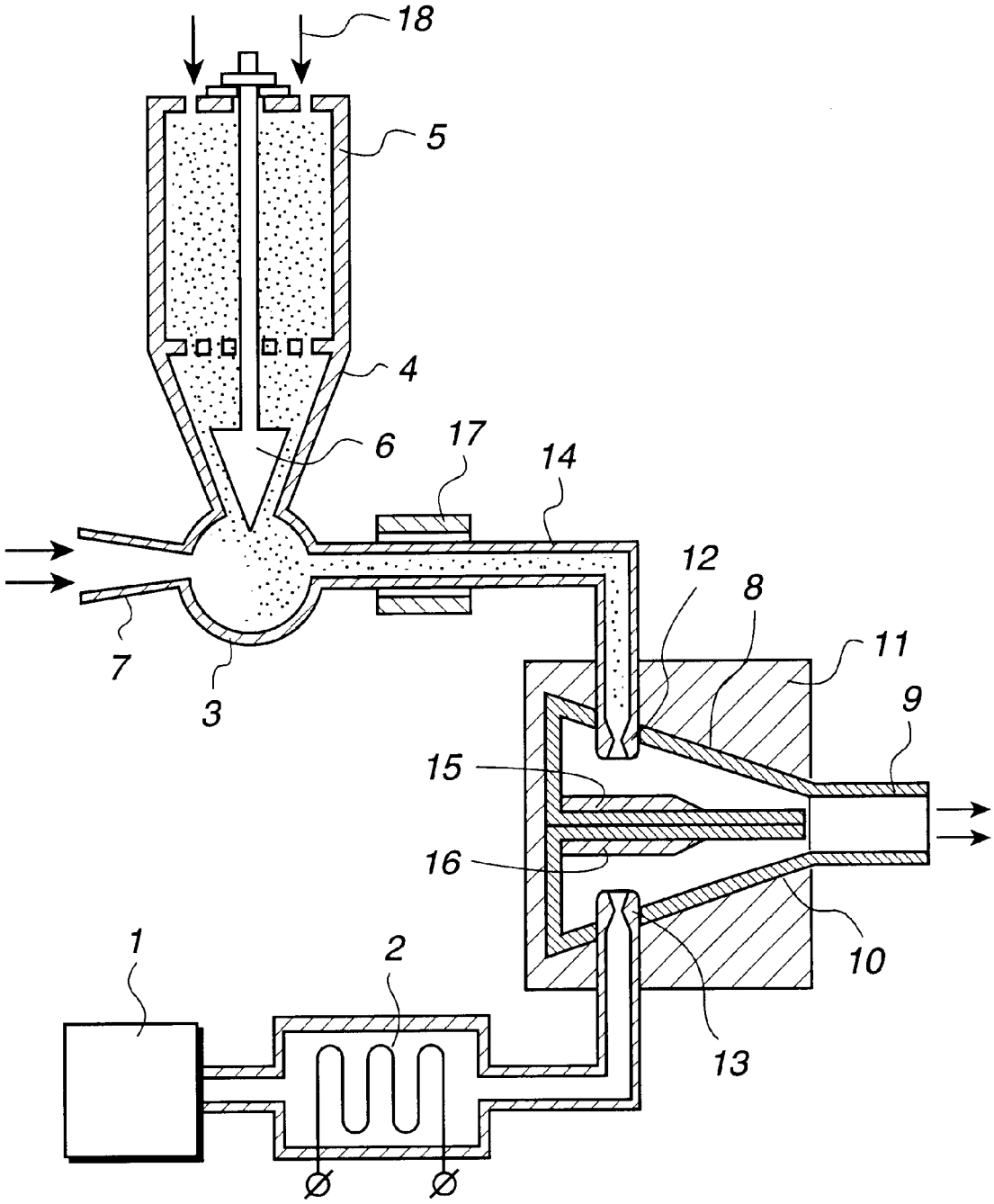
FIG. 1 provides a cross-sectional view of an apparatus for applying powder coatings in accordance with one embodiment of the present invention.

FIG. 1 provides a cross-sectional view of an apparatus for applying powder coatings in accordance with one embodiment of the present invention. The preferred embodiment of the powder coating apparatus includes a compressed air supply 1, a heating unit 2; a mixing chamber 3, a powder dosing feeder 4, a powder bunker 5 and a dosing device 6, and intermediate nozzle 7, two accelerating nozzles 8 and 10 combined into a nozzle unit 11, which has the outlet nozzles sections located in the same plane; an ejection cap 9, placed in the outlet of the nozzle unit 11, sprayers 12 and 13, capable to rotate inside the sub-critical zone of the nozzle 8 and 10. In addition, the accelerating nozzle 8 is equipped with a profile-shaping plate 15, and the accelerating nozzle 10 is equipped with a profile-shaping plate 16. Both plates are fixed to the inner surface of each nozzle. The sprayers placed inside the nozzles and able to rotate provide easy adjustment of the angle at which the gas flow is supplied to each nozzle. Optionally, a heating unit 17 can be placed on a gas pipe 14, which connects outlet of the mixing chamber 3 and the sprayer 12 of the nozzle 8. The heating unit 17 can provide heating of the gas-powder mixture before it is supplied in the accelerating nozzle 8.

The apparatus of FIG. 1 is used to apply a coating of material to a surface. The material to be coated can be metal, metal alloy, ceramics or glass. The apparatus of FIG. 1 operates as follows: When the compressed air supply 1 is on, a lower pressure zone in the accelerating nozzle 8 is created, generating a first gas-carrier flow. Subsequently, air passing through the intermediate nozzle 7 is supplied to the inlet of the mixing chamber 3 under the action of atmospheric pressure. Meanwhile, powder from the dosing feeder 4 connected to the powder bunker 5 begins to be introduced into the mixing chamber 3. The dosing device 6 controls the feeding of the powder into the mixing chamber 3. The powder preferably comprises metals, their blends and dielectrics and the particle size in this case can be 1–100 $\mu$m. The powder mixes with the first gas-carrier flow, and is further directed at an angle to the longitudinal axis of the first accelerating nozzle 8 to its sub-critical zone. A reflected gas-powder flow is generated with a profile preset resulting from the acceleration and redistribution of the kinetic energy as the flow collides with the walls of the accelerating nozzle 8. A gas-powder mixture is formed inside the mixing chamber 3 and then supplied by the gas pipe 14 through the sprayer 12 into the accelerating nozzle 8. The sprayer 12 placed inside the accelerating nozzle 8 can rotate enabling the sprayer 12 to adjust the angle at which the gas-powder flow is supplied relative to the axis of the accelerating nozzle 8. When the gas-powder flow impacts with the profile-shaping plate 15, which is fixed to the inner surface of the nozzle 8, a reflected gas-powder flow with a preset profile is generated and then accelerated towards the outlet of nozzle 8.

Alternatively, a heating unit 17 is placed on the gas pipe 14, connecting outlet of the mixing chamber 3 with the sprayer 12 of the first nozzle 8. The heating unit 17 provides additional heating of the gas-powder flow, right before it is supplied to the accelerated nozzle, which is efficient for powders with high oxidizing properties.

A second gas-carrier flow is produced simultaneously by the compressed air supply 1. This flow is heated and same as the first gas-carrier flow, the second gas-carrier flow is directed at an angle to the longitudinal axis of the second accelerating nozzle 10 to its sub-critical zone. It results in accelerating and redistribution of the kinetic energy in the gas-carrier flow, thus generating its reflected flow with a preset profile. In other words, as the gas-powder flow with a preset profile generated in accelerating nozzle 8, a gas-carrier profile is simultaneously generated in an accelerating nozzle 10. The compressed air supply 1 supplies air past the heating unit 2, a heated gas-carrier flow is supplied to the accelerating nozzle 10. The angle to the axis of the accelerating nozzle 10 at which the heated gas-carrier flow is supplied is adjusted by the sprayer 13, which is capable of rotating inside nozzle 10. When the gas-carrier flow impacts the profile-shaping plate 16, fixed to the inner surface of the nozzle 10, a reflected gas-carrier flow of a preset profile is generated and accelerated as flowing to the outlet of nozzle 10.

The preset profiles of the gas-powder and gas-carrier flow are generated by redistribution of their kinetic energy in each flow. Therefore, the flows are supplied into the subcritical zone of each nozzle at an angle to the longitudinal axis of the nozzles and then the reflected flow is generated. The accelerating nozzles 8 and 10 develop the conditions at which the density of the kinetic energy of the flowing gas and gas-powder flows is rapidly increasing in a comparatively small space, thus providing redistribution of the energy in the plane. Therefore, unlike the nozzles in the prior art where the gas velocity changes linearly along the length of the nozzle, the velocity of the gas inside the accelerating nozzles 8 and 10 changes its value and direction multiple times rapidly.

The ejection cap 9 is placed in the outlet of the nozzle unit 11. The accelerated gas-powder flow of the preset profile superimpose over the accelerated gas-carrier flow with the preset profile inside the ejection cap 9. After that, the generated gas-powder flow with the preset profile is laid over the generated gas-carrier flow of the preset profile, and the cumulative jet is directed to an article. Besides, the gas and gas-powder flows superimpose one over the other inside the ejection cap 9, and particles of the cumulative gas-powder jet are accelerated until their threshold values when particles deposit and cohere to an article. In such cases the second accelerating nozzle 10 for accelerating gas-carrier flow can be made subsonic or supersonic. Whether the nozzle 10 is designed to be subsonic or supersonic depends on the particular application of the present invention. The supersonic nozzle essentially increases the velocity of the gas flow with a given available energy.

The superimposition of the flows enables efficient transportation of the particles up to 100 μm, and allows a wide range of velocity to be selected in directing the cumulative gas-powder jet towards an article. In addition, the independent generation of the gas-powder and gas-carrier flows reduces the effect of active gas surrounding to the particles of the sprayed material and provides homogeneous high-quality structure of the sprayed coating with the properties nearly equal to the properties of the sprayed powder. Moreover, generating the preset profiles by redistributing of their kinetic energy reduces the length of the accelerating nozzles 8 and 10 due to simultaneous and parallel generation of the reflected flows of the gas and powder. Furthermore, the use of two accelerating nozzles 8 and 10 essentially simplifies the process of superimposing these flows and aids in reducing the size of the accelerating nozzles 8 and 10.

Although the ejection cap 9 can be designed in any shape, in the preferred embodiments, the outlet section of the ejection cap 9 is made in a rectangular shape to further provide homogeneous spreading of the cumulative gas-powder flow at the outlet of the apparatus. The rectangular outlet section of the ejection cap 9 provides smooth distribution of the cumulative gas-powder jet profile which produces highly uniformed coatings with high efficiency.

Figure 2:
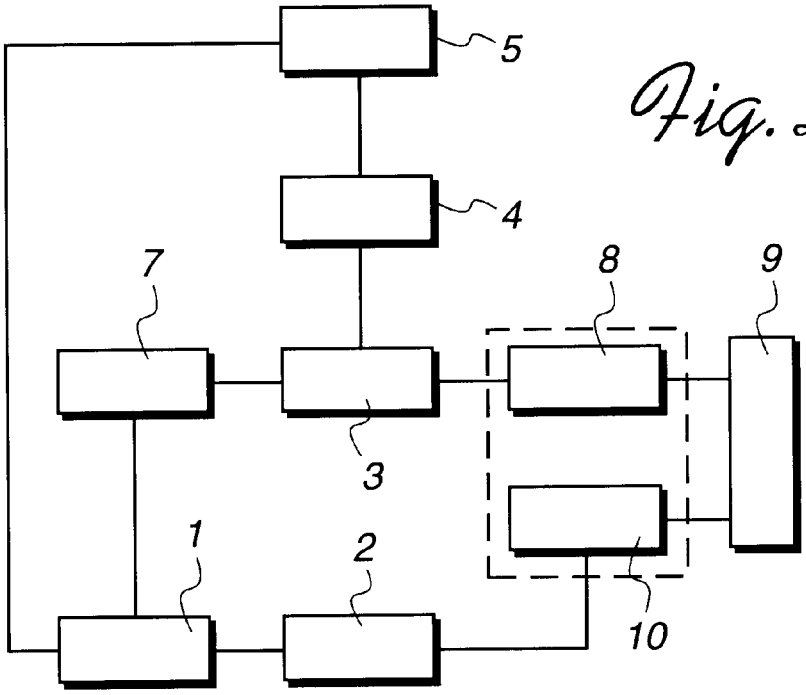
FIG. 2 illustrates an alternative schematic diagram in which the compressed air supply is connected to the intermediate nozzle and powder bunker in accordance with one embodiment of the present invention.

FIG. 2 illustrates an alternative schematic diagram in which the compressed air supply 1 is connected to the intermediate nozzle 7 and powder bunker 5 in accordance with one embodiment of the present invention. Connecting the compressed air supply 1 to the inlet of the intermediate nozzle 7 and the powder bunker 5, increases the velocity of the gas-powder flow and the powder discharge. It will finally result in an increased velocity of the cumulative gas-powder jet in the outlet of the apparatus and provide an increased thickness of the applying coating.

Figure 3:
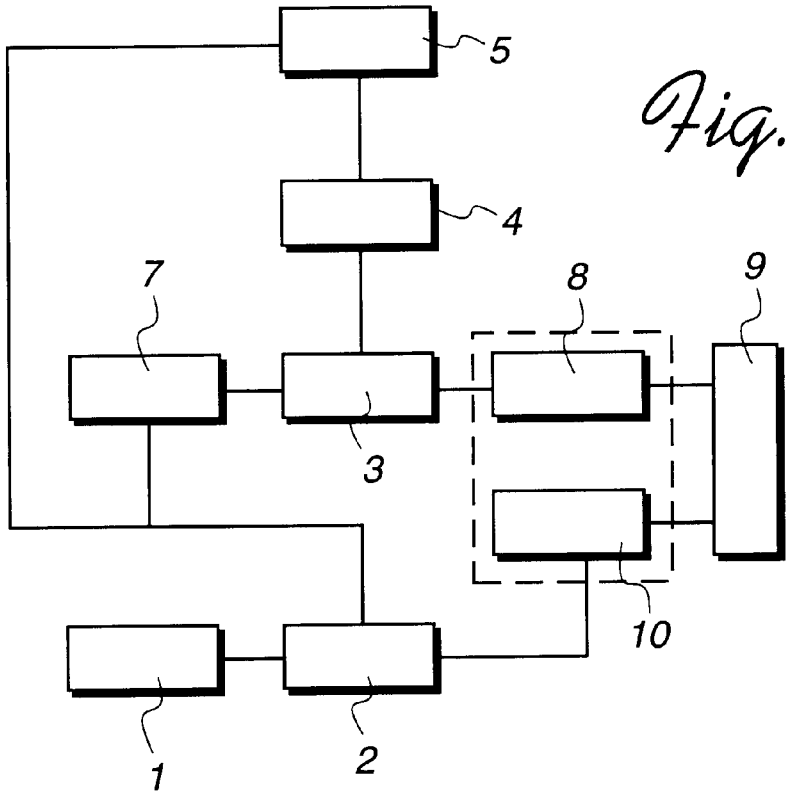
FIG. 3 illustrates an alternative schematic diagram in which the compressed air supply is connected through a heating unit to the inlet of the intermediate nozzle and powder bunker in accordance with one embodiment of the present invention.

FIG. 3 illustrates another alternative schematic diagram in which the compressed air supply 1 is connected through a heating unit 2 to the inlet of the intermediate nozzle 7 and powder bunker 5 in accordance with one embodiment of the present invention. Connection of the compressed air supply 1 via the heating unit 2 to the inlet of the intermediate nozzle 7 and powder bunker 5 is reasonable to use, for example, for applying high melting metals. It provides heating of the powder and gas-carrier, supplied to the mixing chamber 3.

Thus the proposed technical development provides the same efficient and technological application of small-size and large size powder particles with the size of 1–100 μm and produces homogeneous coatings from various types of materials, which properties are nearly equal to the properties of the applied material. Generation of the profiles by redistribution of their kinetic energy enables reducing length of the nozzle due to simultaneous and parallel creation of the reflected gas and gas-powder flows, and therefore to reduce dimensions and enlarge the application of the apparatus.

Therefore, the foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An apparatus for applying to an article a coating of powder material using a compressed air supply, comprising:

a nozzle unit having a first accelerating nozzle and a second accelerating nozzle connected by an ejection cap, wherein the ejection cap connects the outlet sections of the first and second accelerating nozzles in the same plane;

a mixing chamber in communication with the first accelerating nozzle wherein the mixing chamber is connected to an intermediate nozzle and a powder dosing feeder equipped with a powder bunker and a powder dosing device; and a heating unit connected to the compressed air supply and in communication with the second accelerating nozzle.

2. The apparatus of claim 1, further comprising:

a sprayer in each accelerating nozzle capable of rotating in the sub-critical zone of each accelerating nozzle, wherein the sprayer of the first accelerating nozzle is connected via a gas pipe to the outlet of the mixing chamber, and the sprayer of the second accelerating nozzle is connected via the heating unit to the compressed air supply.

3. The apparatus of claim 1, wherein the second accelerating nozzle is supersonic.

4. The apparatus of claim 1, further comprising:

a profile shaping plate fixed to the inner surface of the first and second accelerating nozzles.

5. The apparatus of claim 1, wherein the outlet section of the ejection cap is rectangular.

6. The apparatus of claim 1, wherein the compressed air supply is additionally connected to the inlet of the intermediate nozzle and the powder bunker.

7. The apparatus of claim 1, wherein to the compressed air supply is additionally connected via the heating unit to the inlet of the intermediate nozzle and powder bunker.

8. The apparatus of claim 2, further comprising:

a gas pipe connecting the outlet of the mixing chamber with the first accelerating nozzle; and a second heating device placed on the gas pipe.

9. An apparatus for applying to an article a coating of powder material from powder particles; comprising:

means for generating a first gas-carrier flow;

means for mixing powder particles into the first gas-carrier flow;

means for generating a preset profile for the mixed gas-powder flow;

means for generating a second gas-carrier flow;

means for heating the second gas-carrier flow;

means for generating a preset profile for the second gas-carrier flow;

means for superimposing of the gas-powder flow over the second gas-carrier flow; and means for directing the superimposed flows to the article.

* * * * *